United States Patent [19]

Taguchi et al.

[11] Patent Number: 4,643,599

[45] Date of Patent: Feb. 17, 1987

[54] INKING APPARATUS FOR A WIRE MATRIX PRINTER

[75] Inventors: Tetsuo Taguchi, Kawaguchi; Takashi Ishikawa, Toride, both of Japan

[73] Assignee: Pentel Kabushiki Kaisha, Tokyo, Japan

[21] Appl. No.: 760,599

[22] Filed: Jul. 30, 1985

[30] Foreign Application Priority Data

Jul. 31, 1984 [JP] Japan ..... 59-118621[U]
Jul. 31, 1984 [JP] Japan ..... 59-118622[U]

[51] Int. Cl.[4] ..... B41J 3/12
[52] U.S. Cl. ..... 400/124; 400/470
[58] Field of Search ..... 400/124, 470, 471, 471.1; 101/93.05

[56] References Cited

U.S. PATENT DOCUMENTS 4,194,846 3/1980 Zerillo ..... 400/124
4,279,519 7/1981 Shiurila ..... 400/124
4,456,393 6/1984 Gomi ..... 400/124

FOREIGN PATENT DOCUMENTS 11272 2/1981 Japan ..... 400/124
124671 7/1983 Japan ..... 400/124

*Primary Examiner*—Paul T. Sewell
*Attorney, Agent, or Firm*—Robert E. Burns; Emmanuel J. Lobato; Bruce L. Adams

[57] ABSTRACT

A wire matrix printer head has a group of print wires guided so as to pass through holes formed in an ink reservoir. The group of print wires are operatively connected to an actuator unit provided within a housing, the group of print wires having their free ends slidably supported by a bearing plate secured to one end of the housing. An ink chamber is disposed at the rear of the bearing plate, and within the ink chamber is provided an ink reservoir and a spring urging means for urging the ink reservoir towards the bearing plate. The ink reservoir has a sufficiently large clearance relative to each of the print wires, and accordingly, a supply of ink to the respective print wires is transmitted via the back surface of the bearing plate rather than a direct supply thereof from the ink reservoir to the print wire to prevent a deterioration of the ink reservoir due to highly frequent frictions between the ink reservoir and the respective print wires.

19 Claims, 4 Drawing Figures

INKING APPARATUS FOR A WIRE MATRIX PRINTER

BACKGROUND OF THE INVENTION

The present invention relates to a wire matrix printer head, and more specifically to an inking apparatus which directly supplies liquid ink to a group of print wires.

In a wire matrix printer without requiring an ink ribbon, a group of print wires are guided so as to pass through holes formed in an ink reservoir by which inking is achieved. Ink passes from a tank to a capillary path or a tube and is supplied to the reservoir. The wire printer of the type as described has been known in U.S. Pat. Nos. 4,194,846, 4,279,519 and 4,353,654. U.S. Pat. No. 4,445,127 is also known which discloses the type wherein, instead of provision of an ink reservoir, an ink applicator such as a felt projected from an ink container is brought into direct contact with a group of print wires. In the wire printer using the ink reservoir or ink applicator, the group of print wires are subjected to inking by relatively intensive pressure contact between the print wire and the ink reservoir or the ink applicator. However, as a friction of high level occurs therebetween, the ink reservoir or the ink applicator around the print wires is deteriorated or worn out, failing to insure sufficient inking for a long period of time.

On the other hand, there has been proposed U.S. Pat. No. 4,456,393 disclosing the type in which a group of print wires are guided so as to pass through an ink chamber filled with ink, without using an ink reservoir or an ink applicator. However, in the wire printer of the type as described, a pump device has to be provided to supply pressurized ink to the ink chamber so as to forcibly lubricate the group of print wires.

SUMMARY OF THE INVENTION

It is an object of the present invention to provide an inking apparatus for a wire matrix printer wherein a group of print wires can be wetted by ink impregnated in an ink reservoir, without bringing the ink reserovir and the group of print wires into direct contact with each other.

It is a particular object of the present invention to provide an inking apparatus for a wire matrix printer which reduces deterioration of the ink reservoir and which can insure stabilized inking with respect to the group of print wires for a long period of time.

According to the present invention, there is provided an inking apparatus for a wire matrix printer comprising a housing, an actuator unit carried at the rear end of the housing, a group of print wires one ends of which are operatively connected to the actuator unit, and a bearing plate secured to the forward end of the housing and slidably supporting the other ends of the group of print wires through openings formed in the bearing plate, said housing interiorly comprising a partition wall defining an ink chamber between said wall said bearing plate, an ink reservoir inserted into said ink chamber and having internally a plurality of through-holes, for passing said group of print wires therethrough, each of said through-holes having a diameter sufficient to leave a clearance relative to said print wire passing therethrough so that said print wire does not make frictional contact with said ink reservoir, and urging means secured within said ink chamber to urge said ink reservoir forwardly so that said ink reservoir forcibly comes into contact with the rear side of said bearing plate, whereby ink impregnated in said ink reservoir is squeezed out along the back surface of said bearing plate and is transferred to the group of print wires through said openings in said bearing plate.

According to a preferred embodiment of the present invention, each of the through-holes formed in the ink reservoir has a diameter large enough to form a suitable clearance wire extending therethrough between the ink reservoir and the print, thereby preventing a deterioration in terms of material or wear of th ink reservoir caused by the frictional contact between the ink reservoir and the group of print wires and reducing a load of the actuator unit required for driving the group of print wires. The bearing plate is formed with a plurality of openings in frictional contact engagement with each of the print wires. The bearing plate is formed on the back surface thereof with a plurality of ink guiding grooves in communication with each of the openings, and, in other words, each ink guiding groove is formed with an opening through which each of the print wires extends. Each of the ink guiding grooves of the bearing plate receives the ink from the ink rservoir in contact with the back surface of the bearing plate and supplies the ink to the print wire passing through the opening of the ink guiding groove. In this case, a suitable quantity of ink always stays within each ink guiding groove, so the ink is never exhausted from the print wires.

DETAILED DESCRIPTION OF THE PREFERRED EMBODIMENTS

Figure 1:
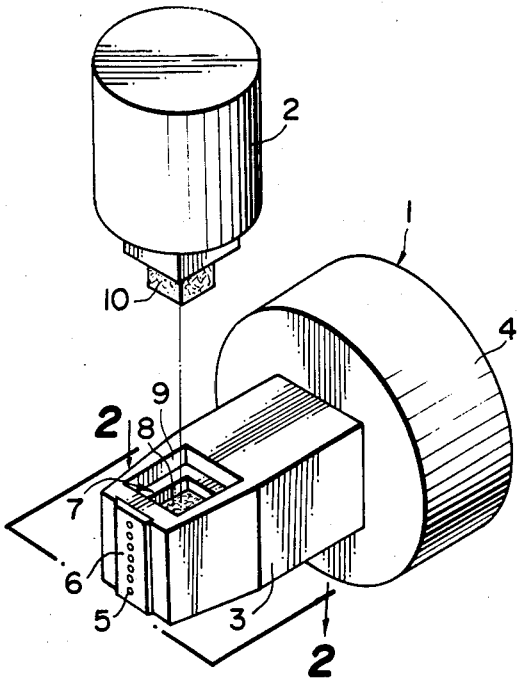
FIG. 1 is a perspective view of a wire matrix printer head to which a concept of the present invention is applied.

Referring to FIG. 1, there is shown a wire matrix printer head 1 which can replaceably receive an ink container 2. The printer head 1 comprises a housing 3 which carries an actuator unit 4, and the housing 3 includes a bearing plate 6 slidably supporting a group of print wires 5 which are operatively connected to the actuator unit 4. The actuator unit 4 for driving the group of print wires 5 will not be described in detail since it is well known but can be one as disclosed, for example, in U.S. Pat. No. 4,225,250. An ink chamber 7 is formed at the forward end of the housing 3, and an ink reservoir 8 composed of a lump of fibers is filled in the ink chamber. The ink chamber 7 is formed with an aperture 9 at the upper portion thereof, through which the ink container 2 can be detachably connected. The ink container 2 has at its one end a capillary path member 10 formed of a relatively hard ink absorbent material, the member 10 being contacted to the ink reservoir 8 through the aperture 9 of the housing 3.

Figure 2:
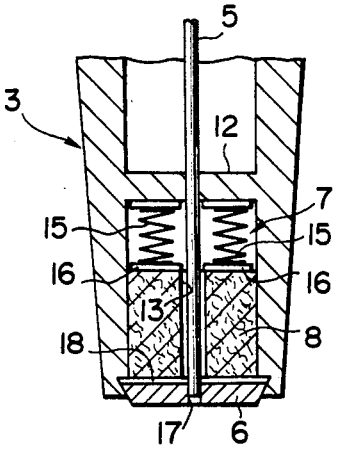
FIG. 2 is a fragmentary cross sectional view taken along line 2—2 of FIG. 2.

As shown in FIG. 2, the ink chamber 7 is located at the forward end of the housing 3 and defined between the bearing plate 6 secured to the housing 3 and a partition wall 12 formed within the housing 3. The partition wall 12 is formed so as to be useful as an intermediate guide for the group of print wires 5. The ink reservoir 8 arranged internally in the ink chamber 7 has a plurality of through-holes substantially in a central portion thereof, and each of the print wires 5 passes through these through-holes 13 respectively. The ink reservoir 8 is formed of a well known lump of fibers and connected to the capillary path member 10 of the ink container 2 (FIG. 1) which is replaceably mounted on the printer head 1. A sufficient quantity of ink can be held with the reservoir 8. The through-hole 13 may be each bored in the ink reservoir 8 or, instead of the through-holes 13, a through-groove for passing the group of print wires therethrough may be formed in the central section of the reservoir. These through-holes may be isolated completely from each other or as the case may be they may be placed in communication with each other through small passageways. In all events, the through-holes or through-groove must have a large inside diameter so as to form a sufficient clearance relative to the print wire 5. In a general wire matrix printer head having the group of print wires 5 comprising 7 or 9 or more wires aligned in a row, essential portions of the ink reservoir 8 surrounding the group of print wires 5 are positioned on opposite sides of the group of print wires 5. Rearwardly in the ink chamber 7 are provided a pair of coil springs which urge the ink reservoir 8 towards the forward bearing plate 6. This pair of coil springs 15 are positioned on the opposite sides reltive to the group of print wires 5 each other and are positioned between the partition wall 12 and the ink reservoir 8. In this case, a pad 16 in contact with the coil spring 15 is mounted at the rear end of the ink reservoir 8. The bearing plate 6 has a plurality of openings 17 slidably supporting the free ends of the group of print wires 5 operatively connected to the actuator unit 4, and the group of print wires 5 pass through the openings or bores 17. At the rear side of the bearing plate 6 are provided a plurality of ink guiding grooves 18 formed in relation with the group of print wires 5. Each groove 18 extends in a direction perpendicular to the print wire 5, and the opening 17 supporting the print wire 5 is formed in the groove. The bearing plate 6 may be formed of saphire or low friction material of hard metal, in which case, a synthetic resin lining (not shown) is provided and the ink guiding groove 18 may be formed in the surface of the lining.

Each of the through-holes 13 formed in the ink reservoir 8 has an inside diameter to form a sufficient clearance between the relevant print wirs 5. As a consequence, the ink reservoir 8 does not principally operate to directly supply the ink to the print wires 5 but rather the ink reservoir 8 is forcibly brought into contact with the back surface of the bearing plate 6 by urging the coil springs 15 against the ink reservoirs to supply the ink to the plurality of ink guiding grooves 18 formed in th bearing plate 6. The ink gruiding groove 18 has an orifice suitable for retaining the ink under the forcible contact between the bearing plate 6 and the ink reservoir 8 so as to guide the ink staying in the orifice tot he print wires 5.

Figure 3:
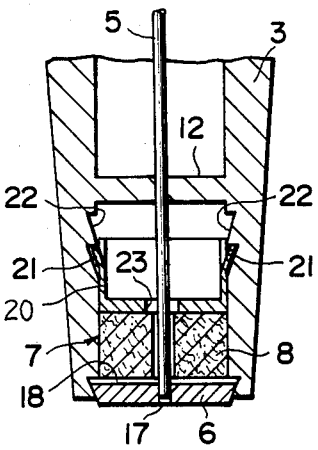
FIG. 3 is a cross sectional view illustrating a modified embodiment of FIG. 2.
Figure 4:
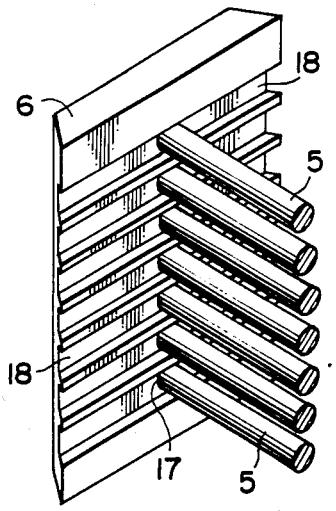
FIG. 4 is a perspective view of a bearing plate shown in FIGS. 2 and 3.

FIG. 3 illustrates a modified plate spring 20 which can be used in place of the pair of coil springs shown in FIG. 2. In FIG. 3, substantially the same parts as those shown in the reveiously explained embodiment are indicated by the same reference numerals. The modified plate spring 20 is formed of an elastic material such as synthetic resin, and is provided with a plurality of pawls 21 projected outwardly. A step 22 is formed on the wall surface of the ink chamber 7 within the housing 3, and the pawl 21 of the plate spring 20 engages the step 22. The plate spring 20 is formed in its central portion with a hole, through which the print wire 5 passes. This modified plate spring 20 acts so as to urge the ink reservoir 8 forwardly by engagement between the step 22 of the housing 3 and the pawl 21. A function similar to the former can be achieved by inserting a spring member formed of an elastic cushion material into the rear portion of the ink chamber 7.

What is claimed is:

1. An inking apparatus for a wire matrix printer comprising: a housing having forward and rearward ends; an actuator unit disposed at the rearward end of the housing; a plurality of print wires extending through the housing between the forward and rearward ends thereof, one end of the print wires being connected to the actuator unit; a bearing plate disposed at the forward end of the housing and having means therein defining bores for slidably supporting the other ends of the print wires; a partition wall disposed in the housing and defining an ink chamber between the partition wall and the bearing plate; an ink reservoir comprised of ink-impregnated material inserted into the ink chamber and having means therein defining an opening for receiving therethrough the print wires, the opening having a sufficient size relative to the print wires so that the print wires do not make frictional contact with the ink reservoir; and urging means disposed in the ink chamber for urging the ink reservoir against the bearing plate to enable the ink absorbed in the ink-impregnated material to be transferred through the bearing plate bores to the print wires.

2. An inking apparatus according to claim 1, wherein the means defining an opening comprises means defining a plurality of through-holes each receiving therein one of the print wires.

3. An inking apparatus according to claim 1, wherein the means defining an opening comprises means defining a through-groove for receiving therein the plurality of print wires.

4. An inking apparatus according to claim 2, wherein the bearing plate has means defining a plurality of ink gruiding grooves on an inner surface thereof, the ink guiding grooves extending in a direction perpendicular to the print wires and communicating with the bores.

5. An inking apparatus according to claim 4, wherein each of the ink guiding grooves includes means defining an orifice for retaining ink squeezed out of the ink-impregnated material due to the urging of the ink reservoir against the bearing plate.

6. An inking apparatus according to claim 5, wherein the urging means comprises a pair of springs engaged between the ink reservoir and the partition wall.

7. An inking apparatus according to claim 4, wherein the urging means comprises a pair of springs engaged between the ink reservoir and the partition wall.

8. An inking apparatus according to claim 2, wherein the urging means comprises a pair of springs engaged between the ink reservoir and the partition wall.

9. An ink apparatus according to claim 2, wherein the ink chamber has means defining an aperture on an upper portion thereof; and an ink container having a capillary path element composed of ink-absorbent material, the capillary path element being insertable into the aperture so as to contact an upper surface of the ink reservoir for enabling the ink stored in the ink container to be transferred to the ink reservoir.

10. An inking apparatus according to claim 4, wherein the ink chamber has means defining an aperture on an upper portion thereof; and an ink container having a capillary path element composed of ink-absorbent material, the capillary path element being insertable into the aperture so as to contact an upper surface of the ink reservoir for enabling the ink stored in the ink container to be transferred to the ink reservoir.

11. An inking apparatus according to claim 5, wherein the ink chamber has means defining an aperture on an upper portion thereof; and an ink container having a capillary path element composed of ink-absorbent material, the capillary path element being insertable into the aperture so as to contact an upper surface of the ink reservoir for enabling the ink stored in the ink container to be transferred to the ink reservoir.

12. An inking apparatus according to claim 3, wherein the bearing plate has means defining a plurality of ink guiding grooves on an inner surface thereof, the ink guiding grooves extending in a direction perpendicular to the print wires and communicating with the bores.

13. An inking apparatus according to claim 12, wherein each of the ink guiding grooves includes means defining an orifice for retaining ink squeezed out of the ink-impregnated material due to the urging of the ink reservoir against the bearing plate.

14. An inking apparatus according to claim 13, wherein the urging means comprises a pair of springs engaged between the ink reservoir and the partition wall.

15. An inking apparatus according to claim 12, wherein the urging means comprises a pair of springs engaged between the ink reservoir and the partition wall.

16. An inking apparatus according to claim 3, wherein the urging means comprises a pair of springs engaged between the ink reservoir and the partition wall.

17. An inking apparatus according to claim 3, wherein the ink chamber has means defining an aperture on an upper portion thereof; and an ink container having a capillary path element composed of ink-absorbent material, the capillary path element being insertable into the aperture so as to contact an upper surface of the ink reservoir for enabling the ink stored in the ink container to be transferred to the ink reservoir.

18. An inking apparatus according to claim 12, wherein the ink chamber has means defining an aperture on an upper portion thereof; and an ink container having a capillary path element composed of ink-absorbent material, the capillary path element being insertable into the aperture so as to contact an upper surface of the ink reservoir for enabling the ink stored in the ink container to be transferred to the ink reservoir.

19. An inking apparatus according to claim 13, wherein the ink chamber has means defining an aperture on an upper portion thereof; and an ink container having a capillary path element composed of ink-absorbent material, the capillary path element being insertable into the aperture so as to contact an upper surface of the ink reservoir for enabling the ink stored in th ink container to be transferred to the ink reservoir.

* * * * *